US012339096B2

(12) United States Patent
Simons

(10) Patent No.: US 12,339,096 B2
(45) Date of Patent: Jun. 24, 2025

(54) APPARATUS FOR STORING AND DISPENSING PROPELLANT, A BULLET, AND A PRIMER FOR A MUZZLELOADER

(71) Applicant: Cedar Mountain Products, LLC, Cedar City, UT (US)

(72) Inventor: Aaron Mark Simons, Cedar City, UT (US)

(73) Assignee: Cedar Mountain Products, LLC, Cedar City, UT (US)

( * ) Notice: Subject to any disclaimer, the term of this patent is extended or adjusted under 35 U.S.C. 154(b) by 0 days.

(21) Appl. No.: 18/432,706

(22) Filed: Feb. 5, 2024

(65) Prior Publication Data

US 2024/0175657 A1 May 30, 2024

Related U.S. Application Data

(63) Continuation-in-part of application No. 29/868,198, filed on Nov. 23, 2022, now Pat. No. Des. 1,020,969.

(60) Provisional application No. 63/501,946, filed on May 12, 2023.

(51) Int. Cl.
*F41C 9/08* (2006.01)

(52) U.S. Cl.
CPC ..... *F41C 9/085* (2013.01)

(58) Field of Classification Search
None
See application file for complete search history.

(56) References Cited

U.S. PATENT DOCUMENTS 4,112,606 A * 9/1978 Griffin ..... F41C 9/085 42/90
4,135,322 A * 1/1979 Tice ..... F41C 9/085 42/90
4,292,877 A * 10/1981 Lee ..... F42B 33/0292 86/29
4,373,285 A 2/1983 Grout
4,411,088 A * 10/1983 Wilson ..... F41C 9/085 42/90
4,419,839 A 12/1983 Wilson
4,550,517 A * 11/1985 Mansfield ..... F41C 9/085 42/90
4,571,873 A * 2/1986 Houk ..... F41C 9/085 222/449
4,783,925 A 11/1988 Pollock, Jr.
4,817,321 A 4/1989 Clement
4,862,623 A * 9/1989 Delap ..... F41C 9/085 42/90

(Continued)

*Primary Examiner* — Derrick R Morgan
(74) *Attorney, Agent, or Firm* — Gurr & Brande, PLLC; Robert A. Gurr

(57) ABSTRACT

A quick loader includes a propellant tube, a main loader body, a funnel valve, and a funnel tube. The funnel valve features a channel that connects the main loader body to the funnel tube, allowing propellant to flow therethrough when open. The funnel valve is coupled to the main loader body by a hinge on a metal pin that enables free rotation around a fixed axis. The funnel valve further features a gasket that covers an outlet of the main loader body when not in use and prevents water from entering the propellant tube. In some embodiments, the quick loader further includes a bullet compartment and a primer holder, configured respectively to hold a bullet and a primer that are accessible with one hand for quick and silent use in the field.

14 Claims, 9 Drawing Sheets

(56) References Cited

U.S. PATENT DOCUMENTS

| | | | | |
|---|---|---|---|---|
| 4,875,303 | A | 10/1989 | DeWeert | |
| 5,081,781 | A | 1/1992 | Kanyuck | |
| 5,092,072 | A * | 3/1992 | Fritts | F41C 9/085 42/90 |
| 5,109,623 | A * | 5/1992 | French | F41C 9/085 42/90 |
| 7,165,351 | B2 | 1/2007 | Church | |
| 11,143,485 | B2 | 10/2021 | Garthaffner | |
| 2004/0244260 | A1 * | 12/2004 | Kanyuck | F41C 9/085 42/90 |
| 2005/0279003 | A1 | 12/2005 | Gunn | |
| 2008/0263927 | A1 * | 10/2008 | Orlob | F41C 9/085 42/90 |
| 2011/0232147 | A1 | 9/2011 | Zoellner | |
| 2019/0041159 | A1 * | 2/2019 | Garthaffner | F41C 9/085 |

* cited by examiner

APPARATUS FOR STORING AND DISPENSING PROPELLANT, A BULLET, AND A PRIMER FOR A MUZZLELOADER

CROSS-REFERENCE TO RELATED APPLICATIONS

This application is a continuation-in-part of U.S. Design patent application Ser. No. 29/868,198, filed on Nov. 23, 2022, and further claims the benefit of U.S. Provisional Application Ser. No. 63/501,946, filed on May 12, 2023, both of which are incorporated herein by reference.

TECHNICAL FIELD

The present disclosure relates to muzzleloaders and quick loading accessories. In particular, the present disclosure relates to an apparatus for storing and dispensing propellant, a bullet, and a primer for a muzzleloader.

BACKGROUND

In many situations involving hunting or competitive shooting with a muzzleloader, rapid reloading is required. Pouring granular propellant, often referred to as loose powder or non-pelletized powder, down the bore of a muzzleloader can be challenging due to the small diameter of the barrel. To further complicate things, in cases where a muzzle brake is installed, the propellant must first be guided through the ports or baffles of the muzzle brake before entering the barrel, usually requiring a long funnel. To reduce reload time, the propellant is often carried in pre-measured containers along with a bullet. When reloading is necessary, the propellant must be transferred from the storage container to the barrel, followed by the bullet.

While it is ideal for this reloading process to be performed as quickly as possible, it can be difficult to execute without spilling propellant. For example, propellant may be spilled due to human error, including shakiness caused by heightened adrenaline levels or shivering in cold weather. In addition, environmental conditions such as wind, rain, and low light can introduce error. Any loss of propellant can result in decreased accuracy. Thus, the propellant and bullet must be stored in a way that is not cumbersome and allows for fast and easy access without allowing moisture to degrade the components—especially the propellant.

Many devices have been invented, such as muzzleloader powder measures, flasks, and funnels, to help streamline the muzzleloader reloading process. Most existing products involve a tube-shaped container in one form or another that may have multiple chambers to hold the separate components. These devices have places to store a pre-measured charge of propellant, a bullet, and in some cases, a primer or ignition cap. Commonly referred to as speed loaders or quick loaders, these devices typically require a cap, funnel, or release pin that cannot be easily removed with one hand and often results in propellant being spilled.

First, most quick loaders have multi-chambered, tube-like containers with caps. When re-loading the muzzleloader is necessary, a cap to the container is removed and the propellant granules are carefully poured into the barrel (or into a separate funnel placed in the end of the barrel). These quick loaders mentioned above require caps to be removed prior to pouring the propellant into the muzzle. This is an extra step, and even the motion of removing the cap can cause the propellant to spill if not done carefully. Also, caps can become snagged and come loose by accident in one's pocket or bag, spilling powder. To prevent spilling the propellant, it must be either poured very slowly and carefully, or a separate funnel must be utilized to guide the granules into the bore.

In cases where a muzzle brake is installed, a funnel with a tube of adequate length is always required to guide the granules through the baffles and ports of the muzzle brake. Funnels are often bulky and cumbersome to carry, and they require the extra step of inserting the funnel into the muzzle. Many of these designs also allow the bullet to rattle around the container, making unnecessary noise that can scare away animals.

Second, in some designs, a funnel-shape or taper has been added to the propellant end of the device to help guide the granules into the barrel. Even with the example where the powder compartment has a tapered end, a cap still has to be removed before dispensing the propellant, and it is possible for the propellant to begin spilling out before the tapered end has been fully inserted into the muzzle. This is especially problematic where a muzzle brake is present, as the propellant will begin pouring out long before the tapered end of the tube can be inserted through the baffles and ports of the brake and into the barrel. The result is that propellant will begin spilling out of the muzzle brake ports and baffles. This design also has the same potential bullet rattle problem as mentioned above.

Third, other inventions have incorporated the use of release pins, push pins, rotating cylinders, or ¼-turn valves to release the propellant and bullet into the muzzle after the device has been carefully placed over the muzzle. Most of these designs are not conducive to one-hand operation, and many of them are also difficult to operate with gloves on. Also, because they are designed to be placed over the outside of the muzzle, they are not well-suited for use with a muzzle brake unless a separate funnel is used to guide the propellant through the muzzle brake baffles/ports. Finally, many of these designs are caliber-specific, making them less versatile than other options available.

Accordingly, a quick loader is needed that holds propellant, a bullet, and a primer, each of which is accessible with one hand for quick and silent use in the field. Ideally, the quick loader should be stored in a compact, collapsed position. During use, the quick loader should guide the propellant down the muzzle without a separate funnel, avoid spilling propellant, and be compatible with a muzzle brake when installed on the firearm. The quick loader disclosed herein solves these and other problems.

SUMMARY OF EXAMPLE EMBODIMENTS

In some embodiments, a quick loader comprises a propellant tube, a main loader body, a funnel valve, and a funnel tube. The propellant tube comprises a transparent, cylindrical body configured to hold a predetermined quantity of propellant. The main loader body may be conical in shape to funnel the propellant from the powder container to the funnel valve. The funnel valve comprises a channel, wherein the funnel valve is coupled to a retaining member by a hinge on a pin such as a binding post that enables free rotation around a fixed axis.

The funnel valve further comprises a gasket or other mechanical seal that covers an outlet of the main loader body when not in use and prevents intrusion of water or debris therein. The funnel tube comprises a long, substantially cylindrical body that may be inserted within the barrel of a muzzleloader and is compatible with a muzzle brake. The quick loader comprises a closed configuration wherein the propellant tube rotates about a rotational axis of the funnel valve, collapsing for easy storage. The quick loader comprises an open configuration that enables propellant to flow freely from the propellant container, through the channel and funnel tube, and into the barrel of the muzzleloader.

In some embodiments, a quick loader comprises a bullet compartment having a cap and a spacer configured to compress a bullet therebetween, preventing the bullet from making any undesirable rattling noise. The quick loader may further comprise a primer holder having a protrusion with a recess configured to receive a primer or cap for a muzzleloader. The propellant, bullet, and primer are each accessible with one hand for easy use in the field.

DETAILED DESCRIPTION OF EXAMPLE EMBODIMENTS

Figure 1:
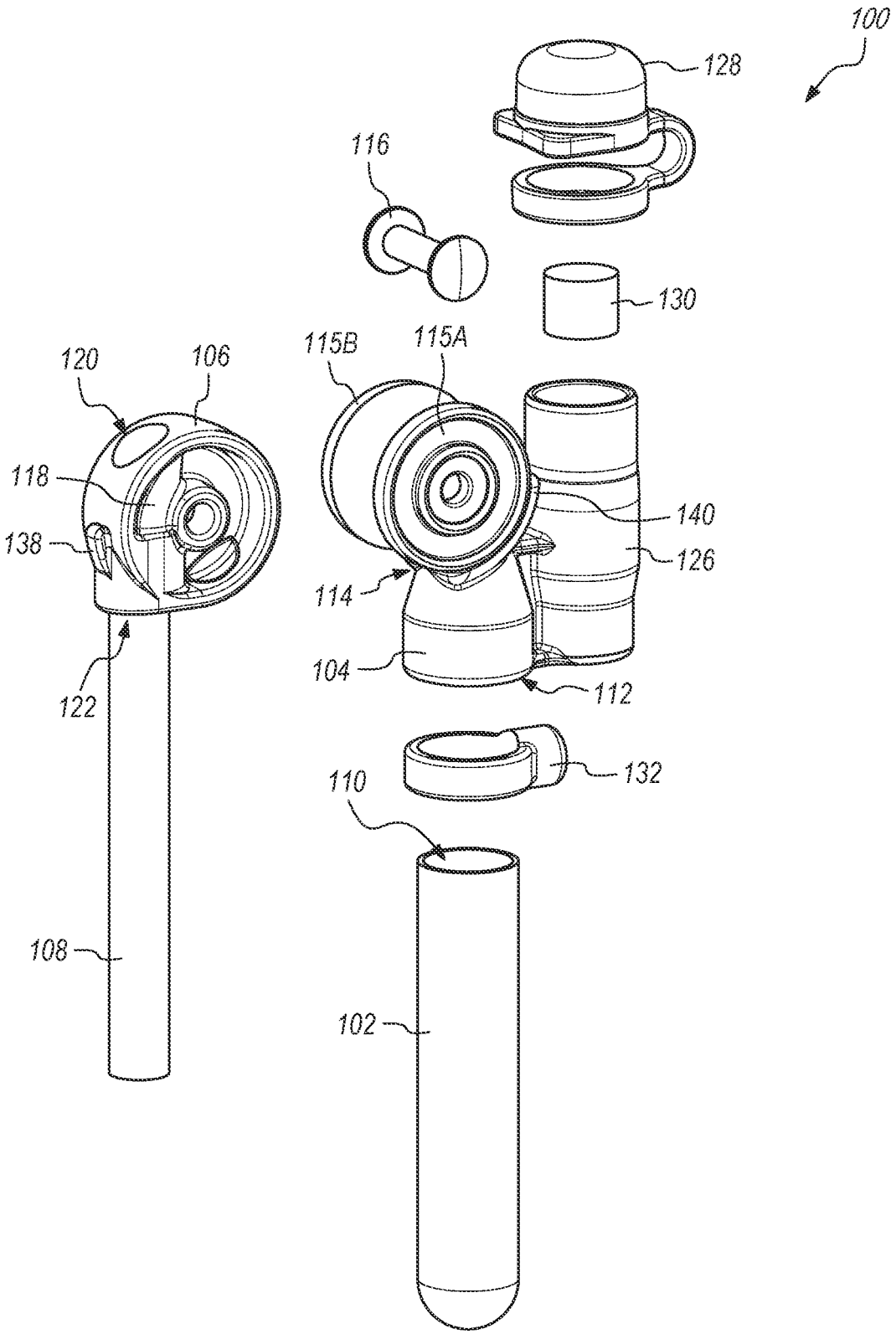
FIG. 1 is an exploded perspective view of a quick loader.
Figure 2:
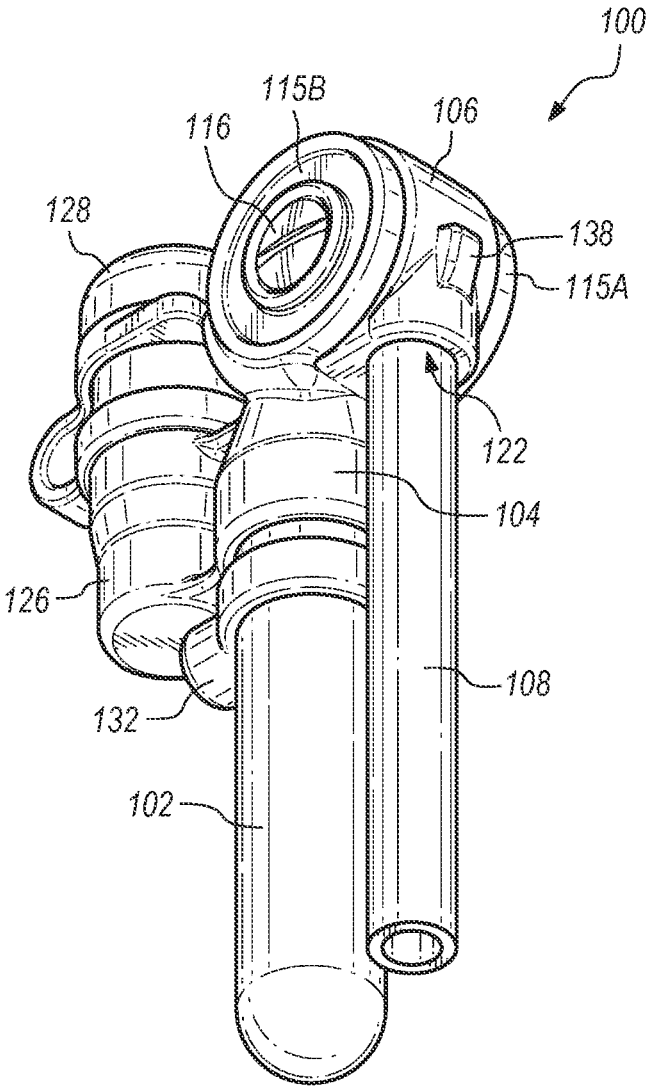
FIG. 2 is a front, right, bottom perspective view of a quick loader.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a quick loader that stores in a compact, collapsed position for easy transportation, that prevents the propellant from spilling, and that guides a propellant down the muzzle without requiring a separate funnel. The quick loader should further be compatible with a muzzle brake installed on the firearm and aid in quickly loading a new charge in preparation for the firearm to be used again. The quick loader disclosed herein solves these and other problems.

Referring to FIGS. 1-8, in some embodiments, a quick loader 100 comprises a propellant tube 102, a main loader body 104, a funnel valve 106, and a funnel tube 108. The propellant tube 102 may comprise a cylindrical body that, in a preferred embodiment, is transparent, enabling a user to see a quantity of propellant contained therein. The propellant tube 102 may comprise a grain capacity by volume, without limitation, between 0-300 and designed for all calibers of muzzleloaders. The propellant tube 102 may comprise indicators, such as marks along a side of the propellant tube 102, for measuring the quantity of propellant. In practice, a user may wipe out the insides of the propellant tube 102 with a dryer sheet prior to filling it with propellant to offset any static electricity and help the propellant to flow more freely.

The propellant tube 102 may comprise an end with an aperture 110 that is coupled to the main loader body 104, such as by compression fit, threaded couplers, locking screws, twist and lock mechanisms, or other known coupling mechanism. The main loader body 104 may be conical in structure, wherein an inlet 112 receives propellant from the propellant tube 102 and funnels the propellant via an outlet 114 (best seen in FIGS. 9-12) into the funnel valve 106. The main loader body 104 may be manufactured from plastic polymers, metals, glass, or alternative materials having a rigid or semi-rigid property. In some embodiments, the main loader body 104 may further comprise a gasket or other mechanical seal that occupies a space between a shared mating surface of the main loader body 104 and the funnel valve 106. The gasket prevents intrusion of water or debris into the main loader body 104 that could dampen the propellant, as well as prevents the propellant from leaving the outlet 114 of the main loader body 104 prematurely. The gasket may be made from standard material such as rubber, plastic, foam, etc.

The funnel valve 106 is rotatably coupled to the main loader body 104 via a first retaining member 115A and a second retaining member 115B by a hinge mechanism, such as a binding post 116, pin, stud, or bearing that enables free rotation around a fixed axis. The retaining members 115A-B, with the funnel valve 106 interposed therebetween, allows the funnel valve 106 and retaining members 115A-B to rotate in relation to one another about the binding post 116. Referring again to FIGS. 9-12, the funnel valve 106 comprises a channel 118 that connects an inlet 120 and an outlet 122 through which propellant 123 may flow between the main loader body 104 and the funnel tube 108 when in correct rotational alignment (e.g., FIG. 12). A cross-sectional area of the channel 118 may be of sufficient size to prevent accumulation of the propellant within the channel 118. In the event of fouling, caused by the propellant 123 or similar unwanted accumulation of materials, the funnel valve 106 and all other components are decouplable and easily cleaned.

Figure 9:
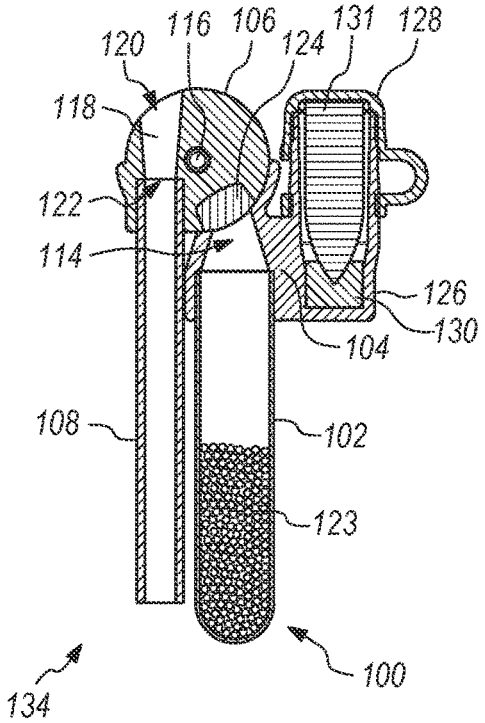
FIG. 9 is a sectional side elevation view of a quick loader in a closed configuration.
Figure 10:
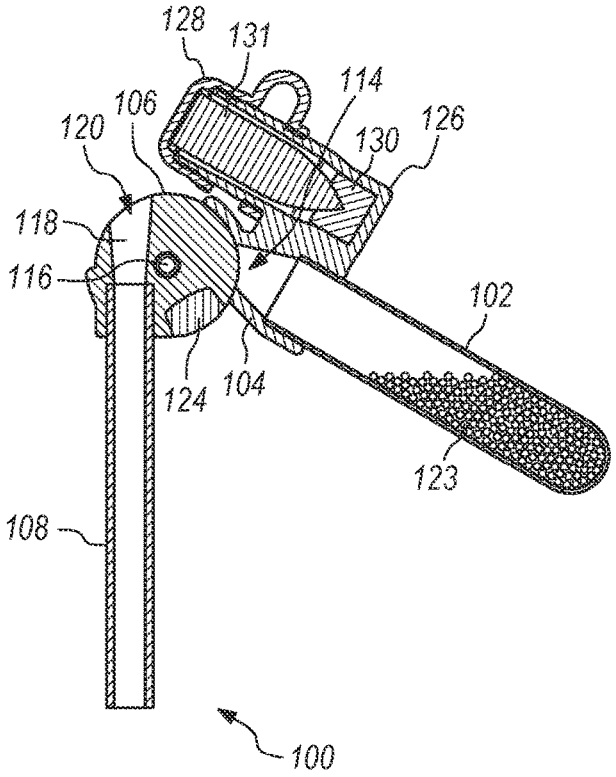
FIG. 10 is a sectional side elevation view of a quick loader extending from a closed configuration to an open configuration.
Figure 11:
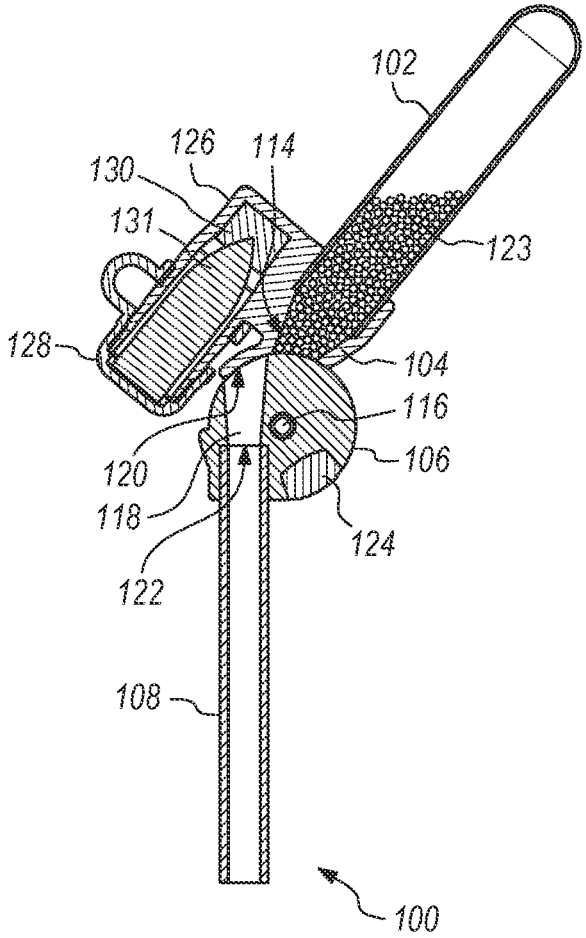
FIG. 11 is a sectional side elevation view of a quick loader extending from a closed configuration to an open configuration.

The funnel valve 106 housing may further comprise a gasket 124 or other mechanical seal that occupies a space between a shared mating surface of the housing main loader body 104 and the rotating funnel valve 106, as best seen in FIG. 9. This gasket 124 prevents intrusion of water or debris into the main loader body 104, outlet 114, and within the propellant tube 102 that could dampen the propellant 123, and to prevent propellant 123 from leaving the outlet 114 of the main loader body 104 prematurely. The gasket 124 may be made from standard materials, such as rubber, plastic, foam, etc.

Figure 13:
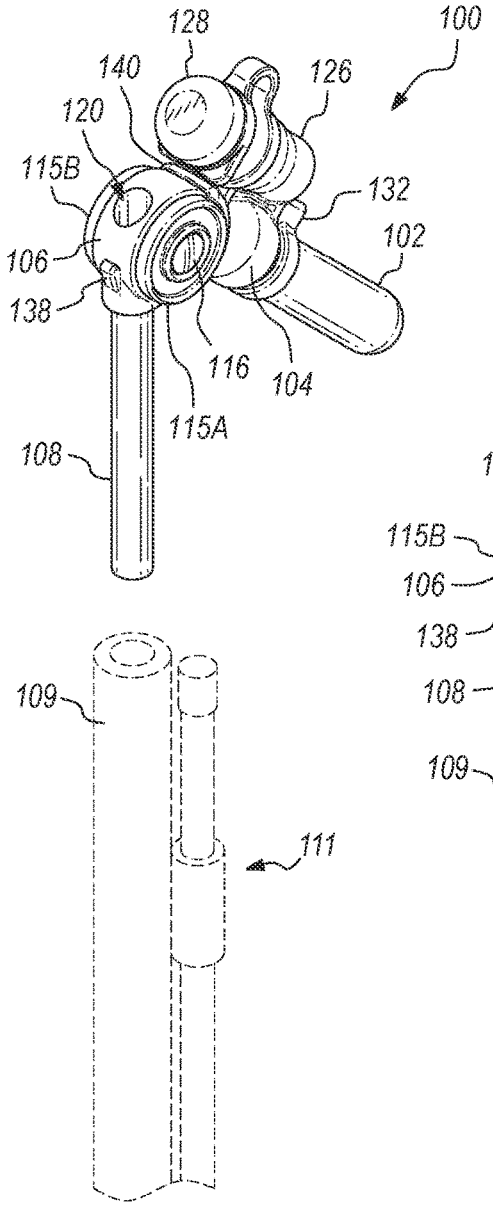
FIG. 13 is a top side perspective view of a quick loader in use with a muzzleloader.
Figure 14:
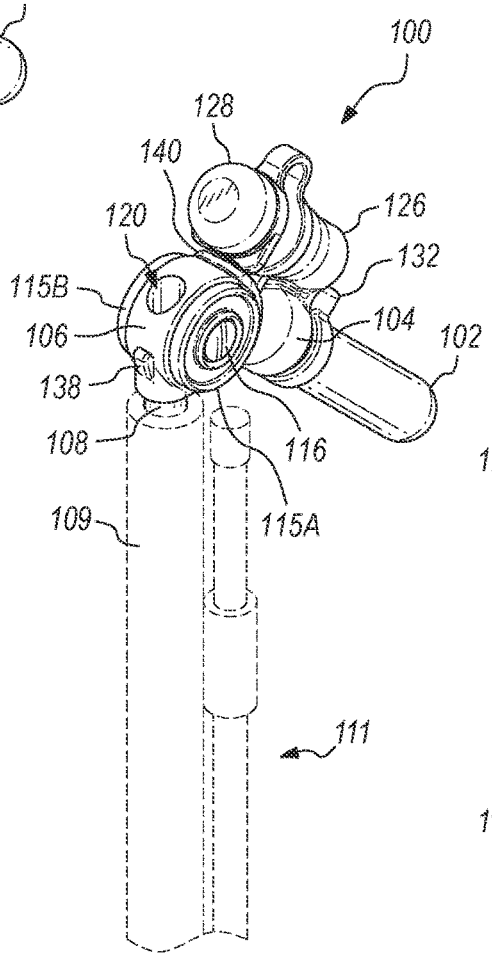
FIG. 14 is a top side perspective view of a quick loader in use with a muzzleloader.
Figure 15:
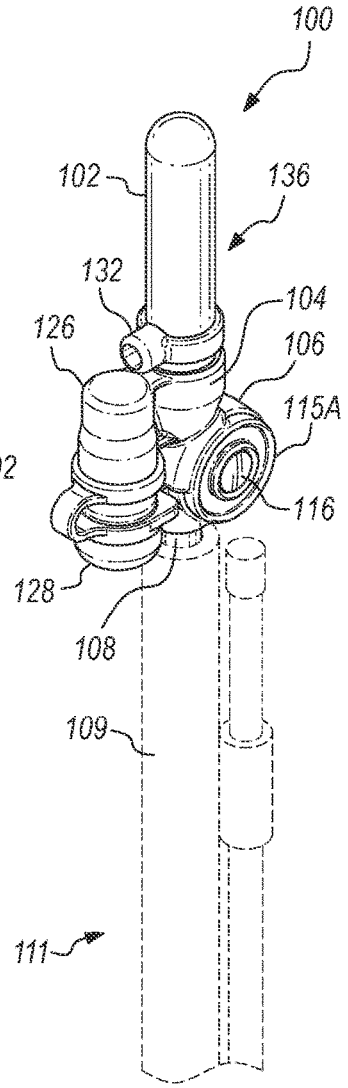
FIG. 15 is a bottom side perspective view of a quick loader in use with a muzzleloader.

The outlet 122 of the channel 118 is coupled to the funnel tube 108. The funnel tube 108 comprises a long, substantially cylindrical body having a diameter that is narrower than a diameter of a barrel of a muzzleloader, such that the funnel tube 108 may be inserted within the barrel of the muzzleloader (as shown in FIGS. 13-15). It will be appreciated that insertion of the funnel tube 108 within the barrel of the muzzleloader, rather than over the barrel, enables propellant to be guided through any ports or baffles of a muzzle brake, if attached.

In some embodiments, the quick loader 100 comprises a bullet compartment 126 having a cap 128 couplable to seal an aperture of the bullet compartment 126. The bullet compartment 126 may comprise a spacer 130 configured to fit within a bottom of the bullet compartment 126 and compress a bullet between the spacer 130 and the cap 128, preventing the bullet from making any undesirable rattling noise during transportation (e.g., hiking). Stealth is critical when approaching wild game in hunting situations where noise could scare away the animal. Thus, it will be appreciated that the spacer 130 comprises foam, rubber, or alternative materials that dampen sound when contacted. As shown, the cap 128 may be tethered to the bullet compartment 126, allowing for easy opening with one hand without fear of dropping or misplacing the cap 128.

Referring to FIGS. 9-12, the bullet 131 is oriented in the bullet compartment 126 with a tip of the bullet against the spacer 130, enabling the bullet 131 to be placed directly into the muzzle of the firearm already facing upwards. This orientation allows loading of the bullet 131 to be done with one hand. The bullet compartment 126, in some embodiments, may be a separate unit that is removably couplable to the main loader body 104 by a binding post or other fastener, or alternatively, may be permanently coupled thereto.

Referring back to FIGS. 1-6, in some embodiments, though without limitation, the quick loader 100 further comprises a primer holder 132 having a rounded body such as a ring with an aperture that is couplable around the propellant tube 102. The primer holder 132 comprises a protrusion having a recess configured to receive a primer or cap for a muzzleloader. Therefore, in some embodiments, it will be appreciated that the quick loader 100 holds propellant 123, a bullet 131, and a primer within the primer holder 132, each accessible with one hand for quick and silent use in the field. While shown and described with a primer holder 132, it will be appreciated that it is not required. Additionally, in some embodiments, it will be appreciated that the primer holder 132 may be a removably attachable accessory, such as by being slidably coupled to the propellant tube 102.

Referring to FIG. 9, the quick loader 100 comprises a closed configuration 134 wherein the inlet 120 of the channel 118 is not in alignment with the outlet 114 of the main loader body 104. In said closed configuration 134, a gasket 124 of the funnel valve 106 covers the outlet 114 of the main loader body 104 such that moisture or debris is prevented from entering the propellant tube 102 through the outlet 114 of the main loader body 104. Accordingly, the propellant 123 is securely stored within the propellant tube 102 and is blocked from entering the channel 118 of the funnel valve 106. The propellant tube 102, in the closed configuration 134, is also parallel and adjacent to the funnel tube 108.

Figure 12:
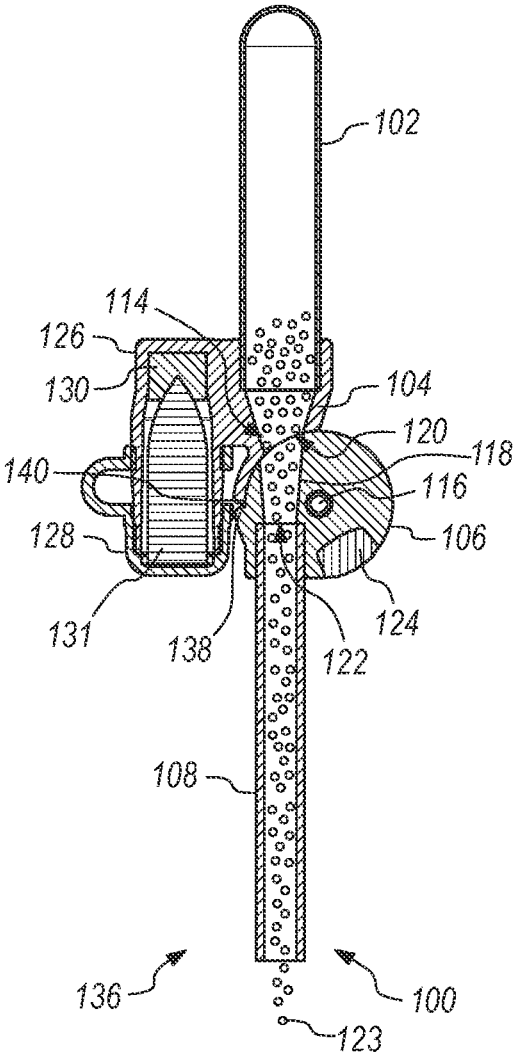
FIG. 12 is a sectional side elevation view of a quick loader in an open configuration.

Referring to FIG. 12, the quick loader 100 correspondingly comprises an open configuration 136, wherein the main loader body 104 coupled to the propellant tube 102 are both rotated about the binding post 116, thereby aligning the outlet 114 with the inlet 120 of the channel 118 of the funnel valve 106. The alignment of the outlet 114 of the main loader body 104 with the inlet 120 of the channel 118 of the funnel valve 106 enables propellant 123 to flow unimpeded from the propellant tube 102 to the funnel tube 108 and into the muzzleloader.

A user may transition the quick loader 100 from the closed configuration 134 to the open configuration 136 by pulling the propellant tube 102 and the funnel tube 108 apart from each other while rotating the main loader body 104 about the binding post 116. For example, as shown in FIGS. 13-15, a user may insert the funnel tube 108 in the barrel 109 of the muzzleloader 111, grasp and rotate, via the main loader body 104, the propellant tube 102, whereby when aligned as in FIG. 12 (the open configuration 136), the propellant 123 freely falls from the propellant tube 102 and into the barrel 109 of the muzzleloader 111. This one-handed operation solves the needs described earlier, overcoming limitations in the prior art.

It will be appreciated that the quick loader 100 is both collapsible and generous in length, as compared to existing models, making it ideal for guiding the propellant through the muzzle into the barrel 109. A separate funnel is not required, enabling compatible use with a muzzle brake when installed on the muzzleloader. Because the funnel tube 108 is connected to the funnel valve 106, it stores in a compact, collapsed position (closed configuration 134) for easy transportation and fits easily in a user's pocket or waist pouch. When folded in the closed configuration 134, the additional length of the funnel tube 108 does not add to the overall length of the quick loader 100.

Referring to FIGS. 13-15, a method of using a quick loader 100 comprises, in some embodiments, a user first rotating a funnel tube 108 away from a propellant tube 102 to create enough clearance to insert the funnel tube 108 into a muzzle of a muzzleloader 111, but still maintaining a closed angle between the funnel tube 108 and the propellant tube 102 (FIG. 13). With the quick loader 100 positioned as described above, a user then inserts the funnel tube 108 as far as possible through the muzzle and into the barrel 109 (FIG. 14). In some methods of use, the funnel tube 108 passes down through any ports or baffles of a muzzle brake and into the barrel 109. Next, with the funnel tube 108 inserted into the muzzle, a user rotates the propellant tube 102 in reference to the funnel tube 108, to a fully open configuration 136 (substantially 180 degrees from an initial closed configuration 134), as shown in FIG. 15. This will align an outlet 114 of the main loader body 104 with an inlet 120 of the channel 118 within the funnel valve 106, allowing propellant to flow freely from the propellant container 102, through the channel 118 and funnel tube 108 (best seen in FIG. 12), and into the barrel 109 of the muzzleloader 111.

Figure 3:
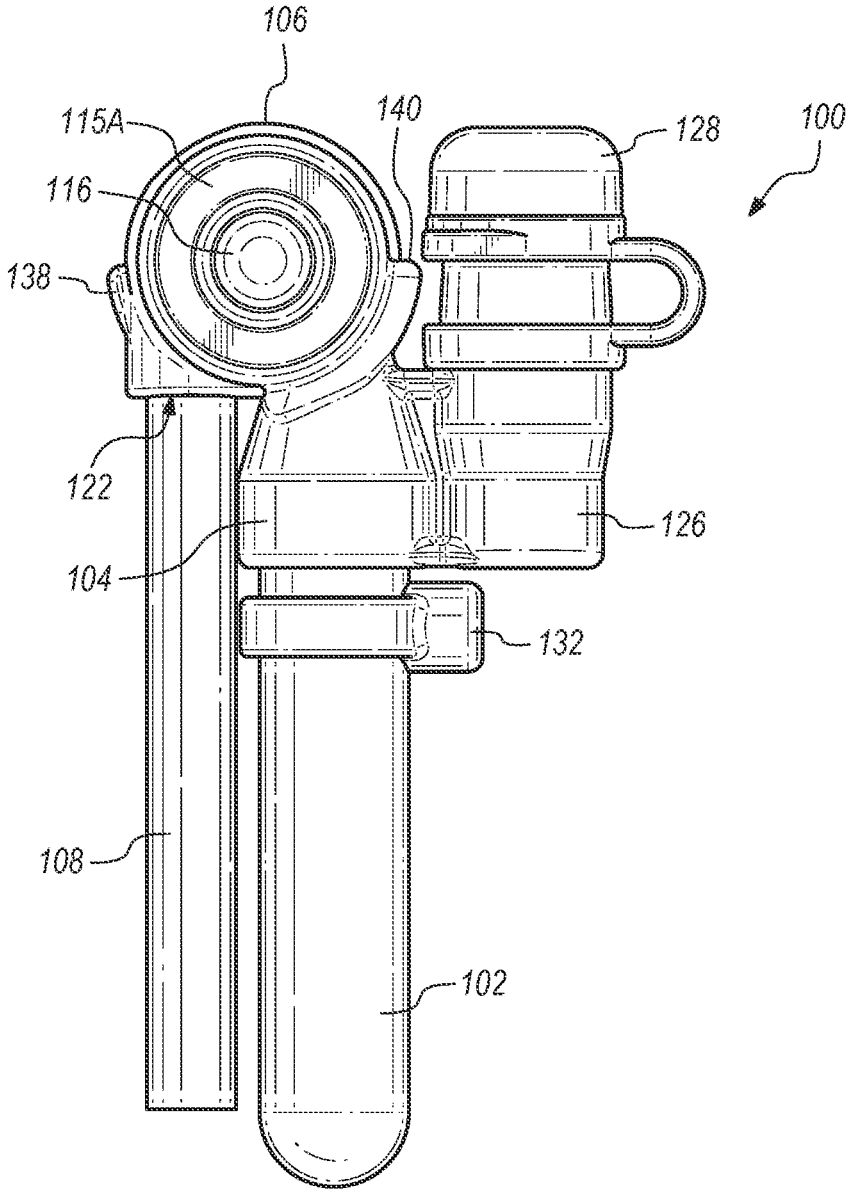
FIG. 3 is a left, side elevation view of a quick loader.
Figure 4:
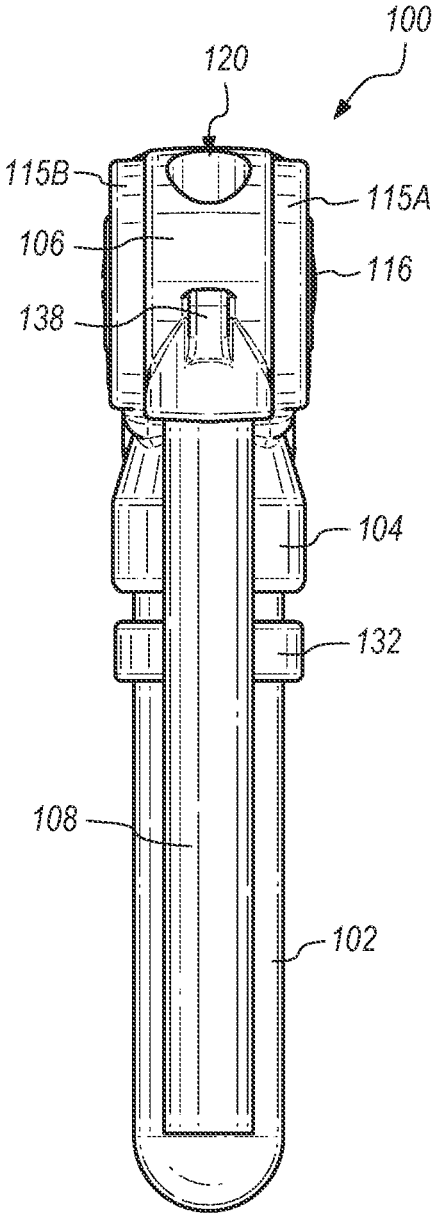
FIG. 4 is a front elevation view of a quick loader.
Figure 5:
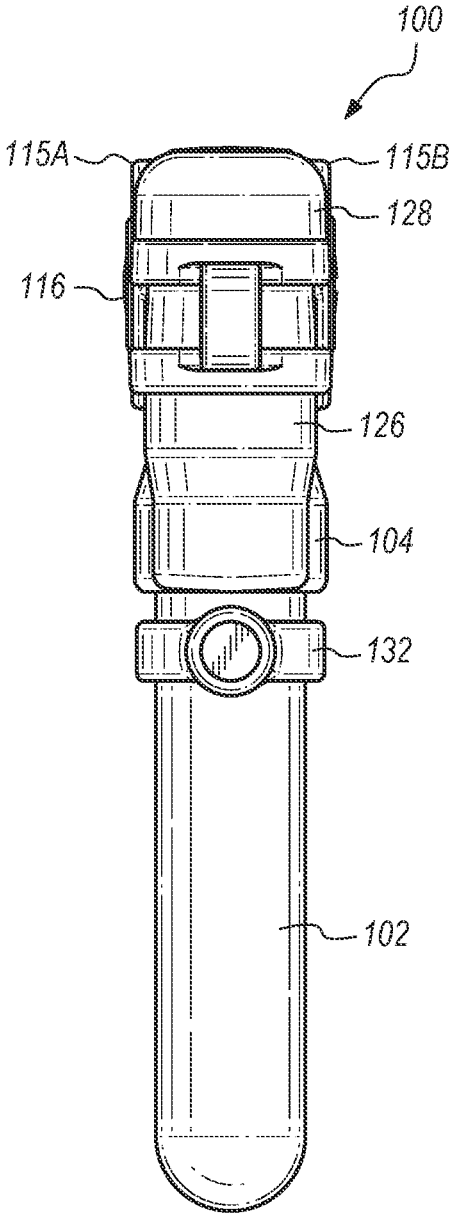
FIG. 5 is a rear elevation view of a quick loader.
Figure 6:
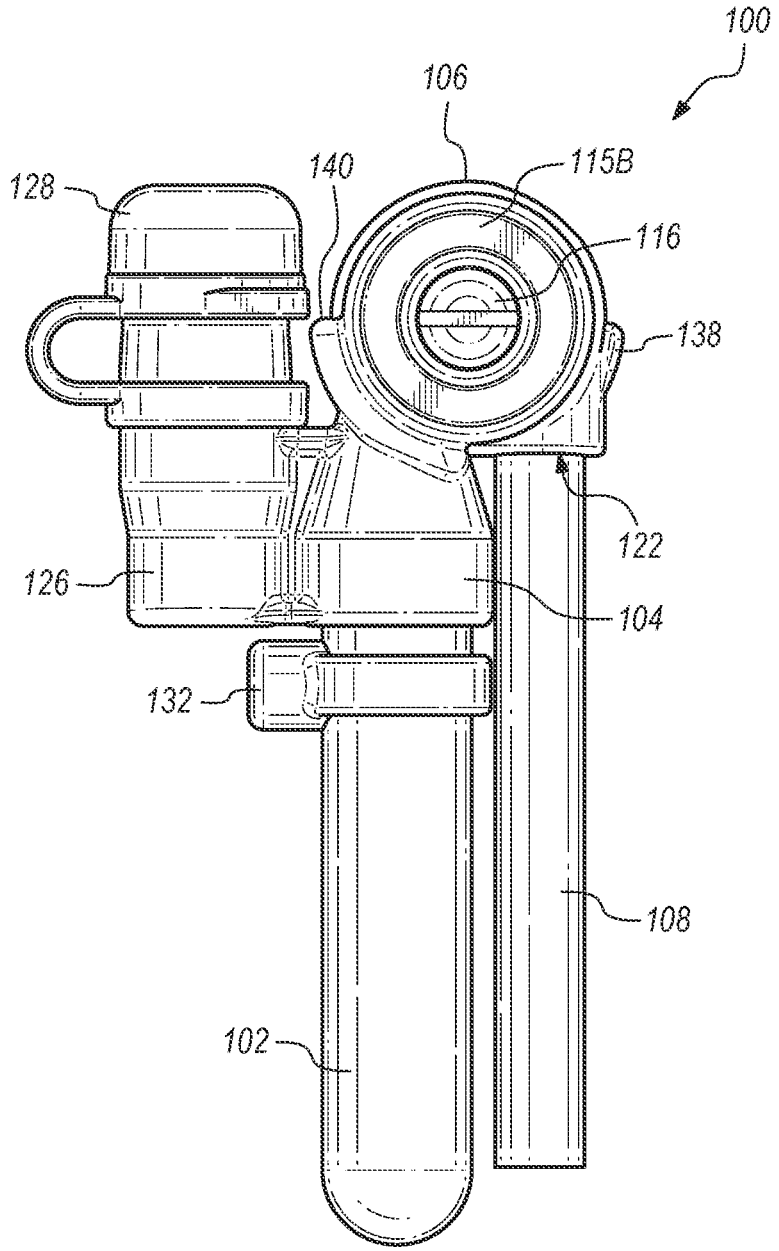
FIG. 6 is a right, side elevation view of a quick loader.
Figure 7:
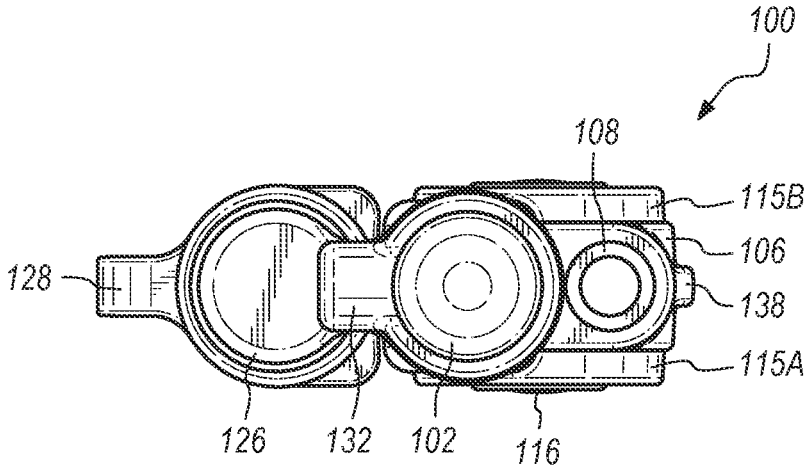
FIG. 7 is a bottom plan view of a quick loader.
Figure 8:
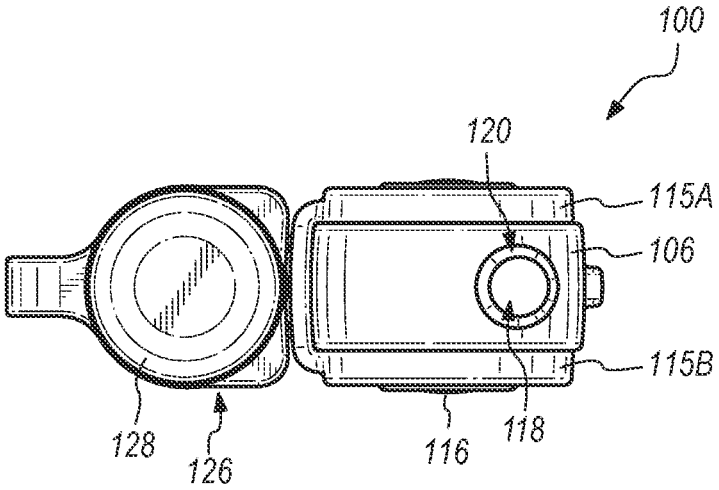
FIG. 8 is a top plan view of a quick loader.

As best seen in FIG. 3, in some embodiments, to prevent over-rotation of the main loader body 104 and the coupled propellant tube 102 in reference to the funnel valve 106, an alignment protrusion 138 or other mechanism on the funnel valve 106 may be used to ensure correct alignment of the outlet 114 of the main loader body 104 with the inlet 120 of the funnel valve 106. For example, when the main loader body 104 is rotated about the binding post 116, a lip 140 (or other protrusion) on the main loader body 104 will contact the alignment protrusion 138 on the funnel valve 106 (shown in FIG. 12), preventing further rotation and ensuring alignment of the propellant tube 102 with the channel 118 and funnel tube 108.

As appreciated, because there is no cap to remove from the funnel tube 108 or the propellant tube 102, a user can complete the above actions with one hand without fear of spilling propellant, overcoming limitations in the prior art. Further, because the funnel tube 108 is within the barrel 109 prior to dispensing, adverse conditions such as wind, low light, cold temperatures, etc. do not adversely affect reloading. Also, human error, including shakiness caused by heightened adrenaline levels or shivering in cold weather, is less likely to adversely affect reloading.

After the propellant has been fully dispensed, a user then removes the funnel tube 108 of the quick loader 100 from the barrel 109 and returns it to the closed configuration 134 by rotating the funnel tube 108 towards the propellant tube 102. A user may further remove a cap 128 of a bullet compartment 126 and place a bullet 131 through the muzzle and into the barrel 109. Because the bullet 131 had been oriented in the quick loader 100 with the tip in and against the spacer 130, when the bullet 131 is placed into the muzzle, the bullet 131 will come out of the bullet compartment 126 already oriented correctly with the tip pointed upwards. Finally, a user can then proceed to complete the reload process per standard muzzleloading practices. As part of the reload process, and prior to discharging the firearm, a user removes a primer or similar ignition device from the primer holder 132, if present, and inserts it in the appropriate location in the firearm.

In some embodiments, the now-empty propellant tube 102 may be quickly removed from the main loader body 104, such as by pulling, twisting, etc. and a new, pre-filled propellant tube 102 may be coupled to the main loader body 104 for the next reload.

It will be appreciated that the quick loader 100 disclosed herein stores in a compact, collapsed position for easy transportation and storage. The funnel tube 108 further guides propellant 123 down the barrel 109 of a firearm without requiring a separate funnel and is compatible with a muzzle brake. The quick loader 100 holds the propellant 123, a bullet 131, and a primer in a primer holder 132, each of which is accessible with one hand for quick and silent use in the field. Accordingly, the quick loader 100 disclosed herein solves the identified problems of the prior art.

It will be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A quick loader for a muzzleloader, comprising:

a propellant tube coupled to a main loader body, the main loader body comprising an inlet and an outlet;

the main loader body coupled to and rotatable around a funnel valve, the funnel valve comprising a channel therethrough; and a funnel tube coupled to the funnel valve and aligned with the channel;

wherein in a first, closed position, the propellant tube and the outlet of the main loader body are not aligned with the channel; and in a second, open position, the propellant tube and the outlet of the main loader body are aligned with the channel and funnel tube.

2. The quick loader of claim 1, wherein the funnel valve further comprises an alignment protrusion.

3. The quick loader of claim 2, wherein the main loader body comprises a lip configured to abut the alignment protrusion when the quick loader is in the second, open position.

4. The quick loader of claim 1, wherein the funnel valve further comprises a gasket positioned to seal the outlet of the main loader body when the quick loader is in the first, closed position.

5. The quick loader of claim 1, wherein the main loader body further comprises a bullet compartment.

6. The quick loader of claim 5, wherein the bullet compartment further comprises a cap.

7. The quick loader of claim 5, wherein the bullet compartment further comprises a spacer.

8. The quick loader of claim 1, further comprising a primer holder.

9. The quick loader of claim 8, wherein the primer holder is configured to removably attach to the propellant tube.

10. A quick loader for a muzzleloader, comprising:

a propellant tube coupled to a main loader body, the main loader body comprising an inlet and an outlet;

the main loader body coupled to and rotatable around a funnel valve via a binding post, the funnel valve comprising a channel therethrough;

a funnel tube coupled to the funnel valve and aligned with the channel;

a gasket coupled to the funnel valve;

a bullet compartment coupled to the main loader body;

an alignment protrusion protruding from the funnel valve; and a lip on the main loader body;

wherein in a first, closed position, the propellant tube and the outlet of the main loader body are not aligned with the channel and the outlet is sealed by the gasket; and in a second, open position, the propellant tube and the outlet of the main loader body are aligned with the channel and funnel tube, the lip abutting the alignment protrusion.

11. The quick loader of claim 10, wherein the bullet compartment further comprises a cap tethered to the bullet compartment.

12. The quick loader of claim 10, further comprising a primer holder.

13. The quick loader of claim 12, wherein the primer holder is configured to removably attach to the propellant tube.

14. The quick loader of claim 10, wherein the bullet compartment further comprises a spacer.

* * * * *